US005967631A

United States Patent [19]

Ko

[11] Patent Number: 5,967,631

[45] Date of Patent: Oct. 19, 1999

[54] COMPUTER DESK

[76] Inventor: Wen-Shan Ko, P.O. Box 23-487, Changhua City 500, Taiwan

[21] Appl. No.: 09/232,669

[22] Filed: Jan. 19, 1999

[30] Foreign Application Priority Data

Oct. 23, 1998 [TW] Taiwan ..... 87217559

[51] Int. Cl.[6] ..... A47B 17/00

[52] U.S. Cl. ..... 312/194; 312/195; 312/208.1; 312/223.3; 108/92; 108/50.01

[58] Field of Search ..... 312/208.1, 223.3, 312/194, 195, 196, 280, 281; 108/92, 101, 50.01

[56] References Cited

U.S. PATENT DOCUMENTS

| | | | |
|---|---|---|---|
| 3,068,821 | 12/1962 | Hermanns | 108/101 X |
| 3,165,367 | 1/1965 | Rose | 312/281 X |
| 4,646,655 | 3/1987 | Robolin | 108/92 |
| 4,974,913 | 12/1990 | Vogt et al. | 312/195 |
| 5,205,631 | 4/1993 | Wegman et al. | 312/208.1 X |
| 5,419,525 | 5/1995 | Hilton | 312/223.3 X |
| 5,568,773 | 10/1996 | Hung | 312/223.3 X |
| 5,623,881 | 4/1997 | Huang | 108/92 X |
| 5,660,450 | 8/1997 | Huang | 312/194 |

FOREIGN PATENT DOCUMENTS

| | | | |
|---|---|---|---|
| 531794 | 3/1993 | European Pat. Off. | 312/223.3 |

*Primary Examiner*—Peter M. Cuomo
*Assistant Examiner*—James O. Hansen

[57] ABSTRACT

A computer desk is composed of a desk top, a reference slide, an article tray, a stationery rack, a drawer, two legs, two leg-supporting bases, a cross rod, and a connection rod. The desk top, the reference slide, the article tray, the stationery rack, the drawer are supported by three sets of support frames. The legs are supported by the leg-supporting bases in conjunction with the connection rod and the cross rod. The legs are provided at a top end thereof with a fitting seat which is in turn provided with a through hole for receiving a curved tube for connecting two computer desks side by side. The curved tube is provided with a support board located between the two computer desks to provided an added work space.

4 Claims, 7 Drawing Sheets

COMPUTER DESK

FILED OF THE INVENTION

The present invention relates generally to a desk, and more particularly to a computer desk.

BACKGROUND OF THE INVENTION

The conventional computer desks are generally rather cumbersome and complicated in construction such that the component parts are joined together by a number of the connection means that are fixed. As a result, the conventional computer desks are not cost-effective. In addition, the conventional computer desks are rather monotonous in design and construction.

SUMMARY OF THE INVENTION

It is therefore the primary objective of the present invention to provide a computer desk which is relatively simple in construction and is therefore cost-effective.

It is another objective of the present invention to provide a computer desk which is versatile in design such that the work tops, the drawers, and the stationery racks of the computer desk can be rearranged easily to suit specific purposes.

It is another objective of the present invention to provide a computer desk which is compact and stable.

It is still another objective of the present invention to provide a computer desk which can be joined side by side with another computer desk of the present invention.

The objectives, features, functions, and advantages of the present invention will be more readily understood upon a thoughtful deliberation of the following detailed description of the present invention with reference to the accompanying drawings.

DETAILED DESCRIPTION OF THE INVENTION

Figure 1A:
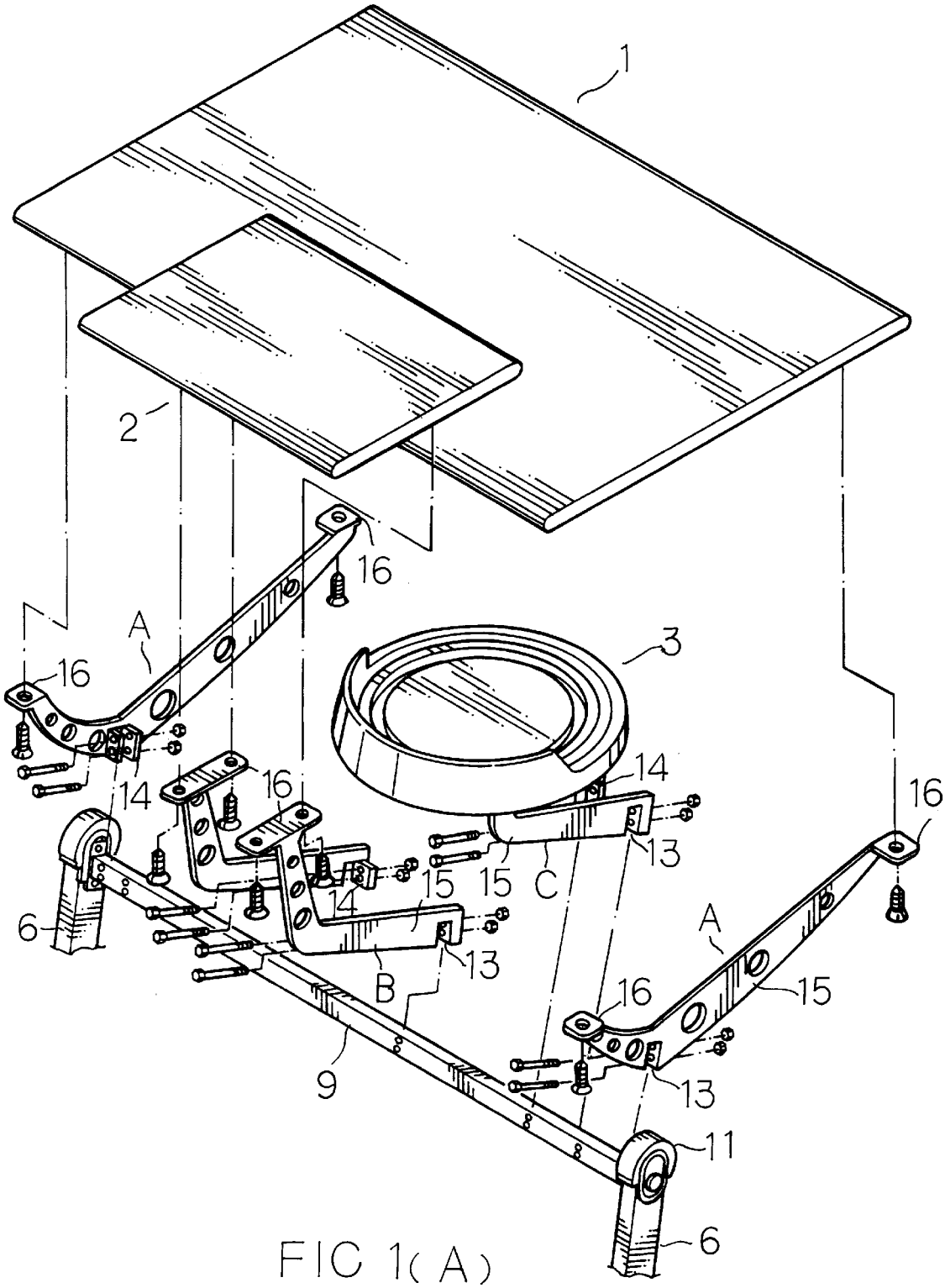
FIG. 1 shows an exploded view of the present invention.
Figure 1B:
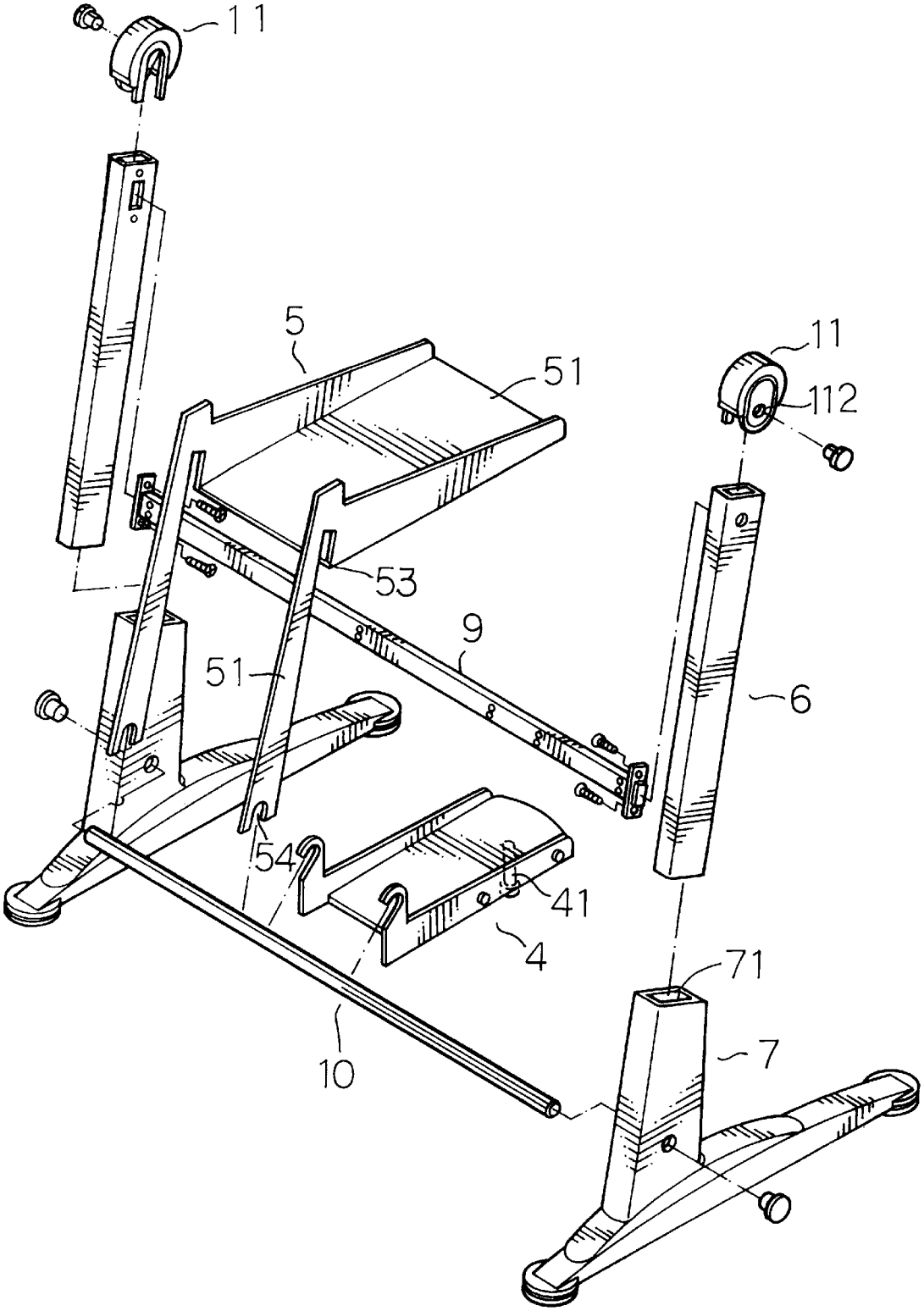
Figure 2:
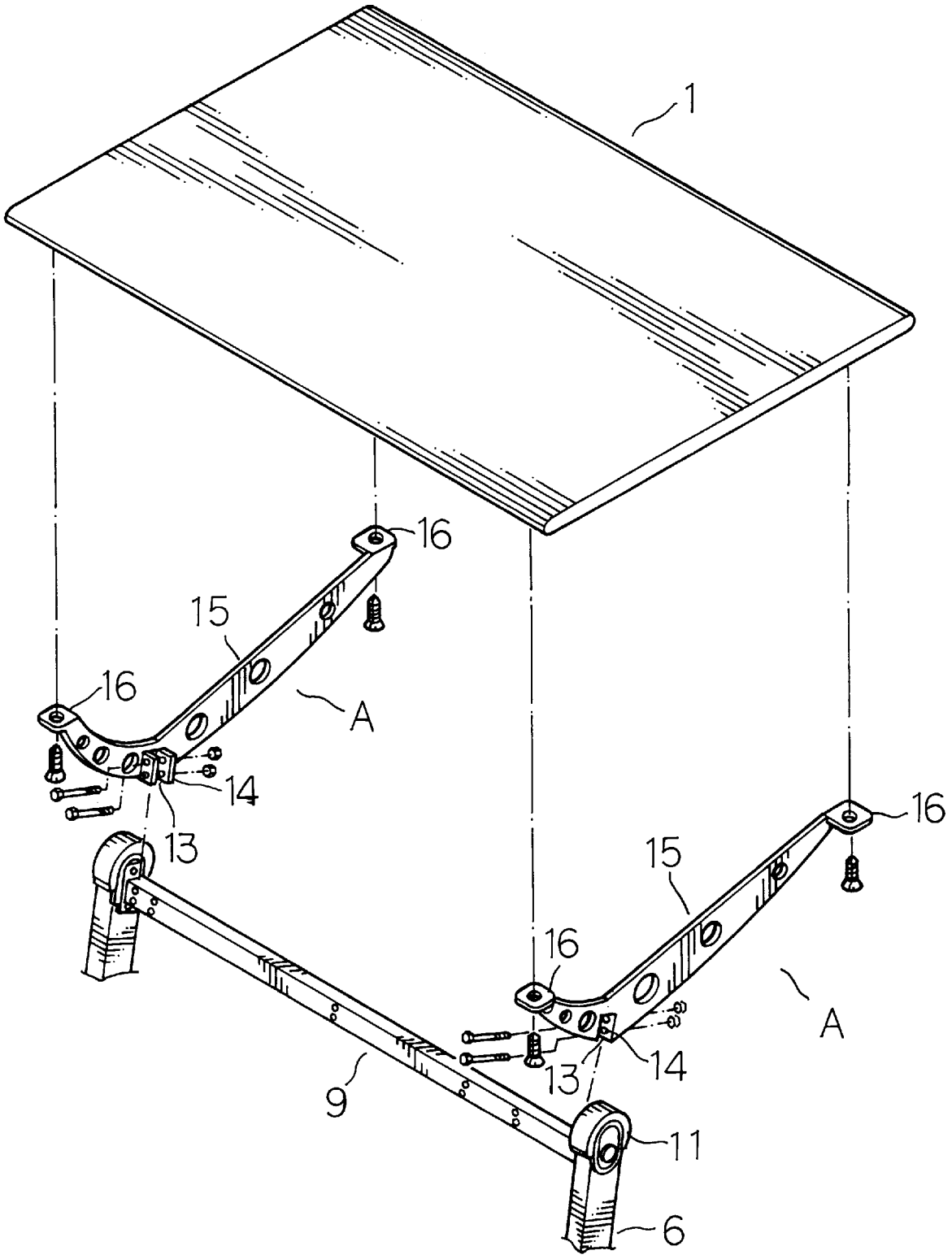
FIG. 2 shows a partial exploded view of the present invention.
Figure 3:
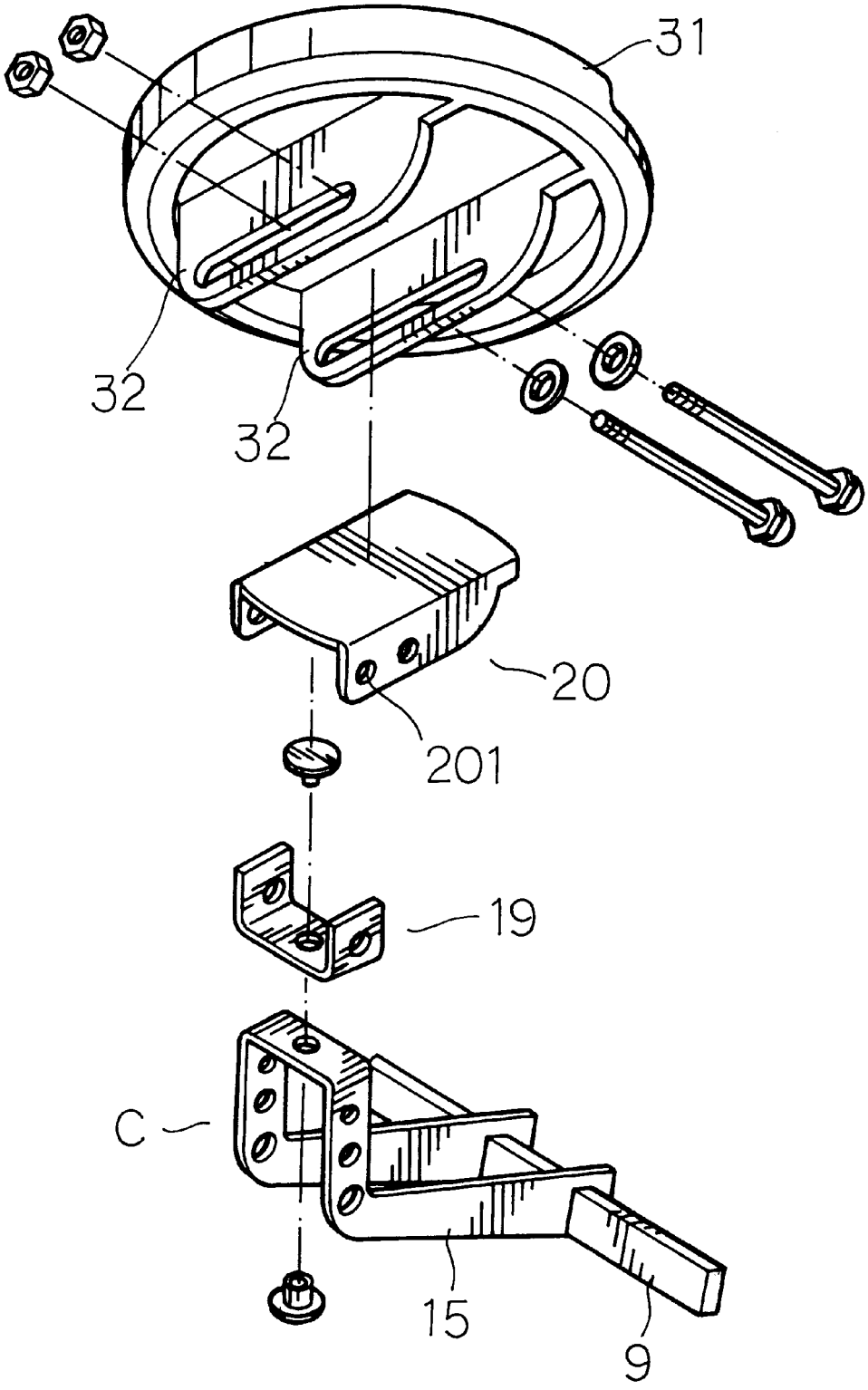
FIG. 3 shows another partial exploded view of the present invention.
Figure 4:
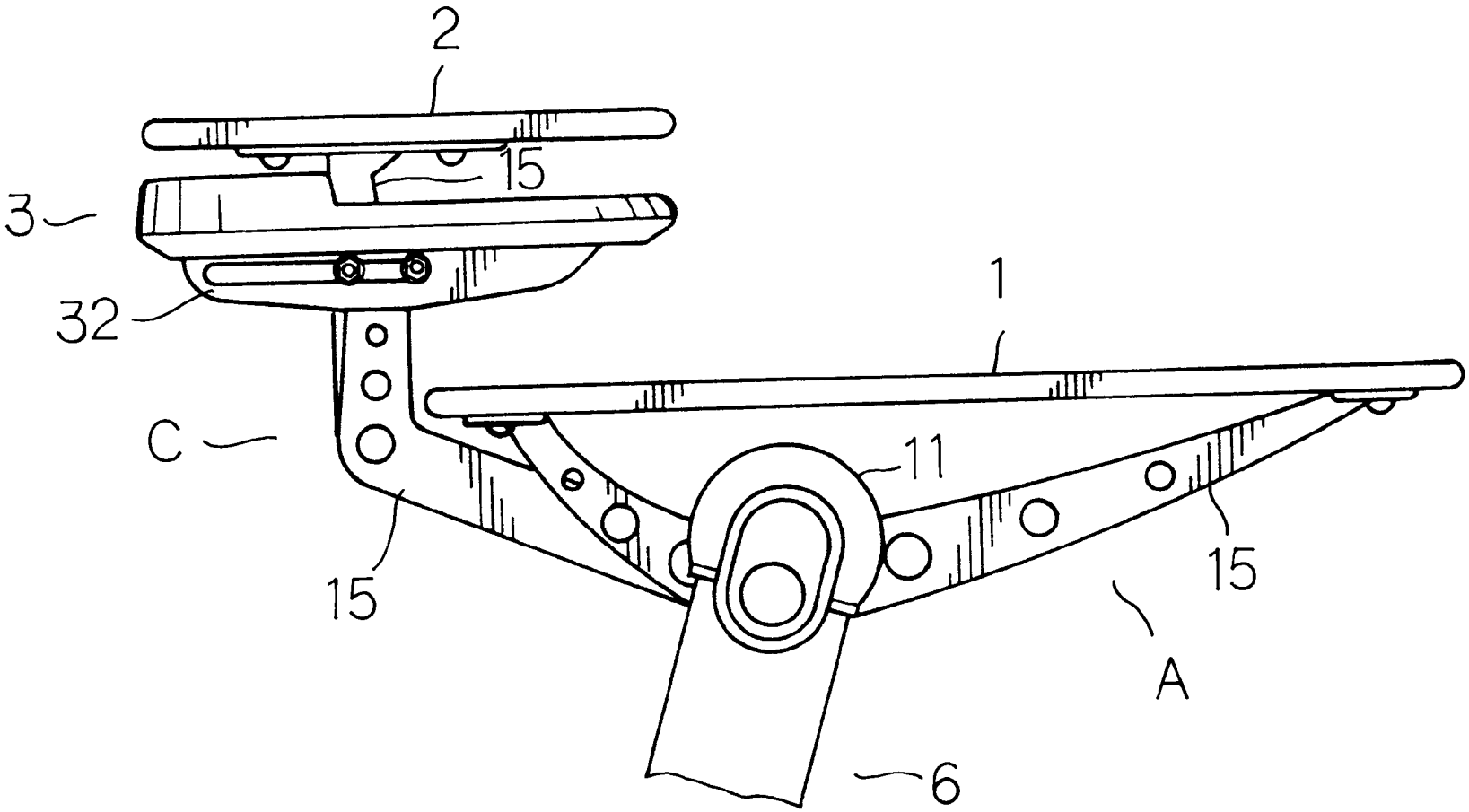
FIG. 4 shows a partial side view of the present invention.
Figure 5:
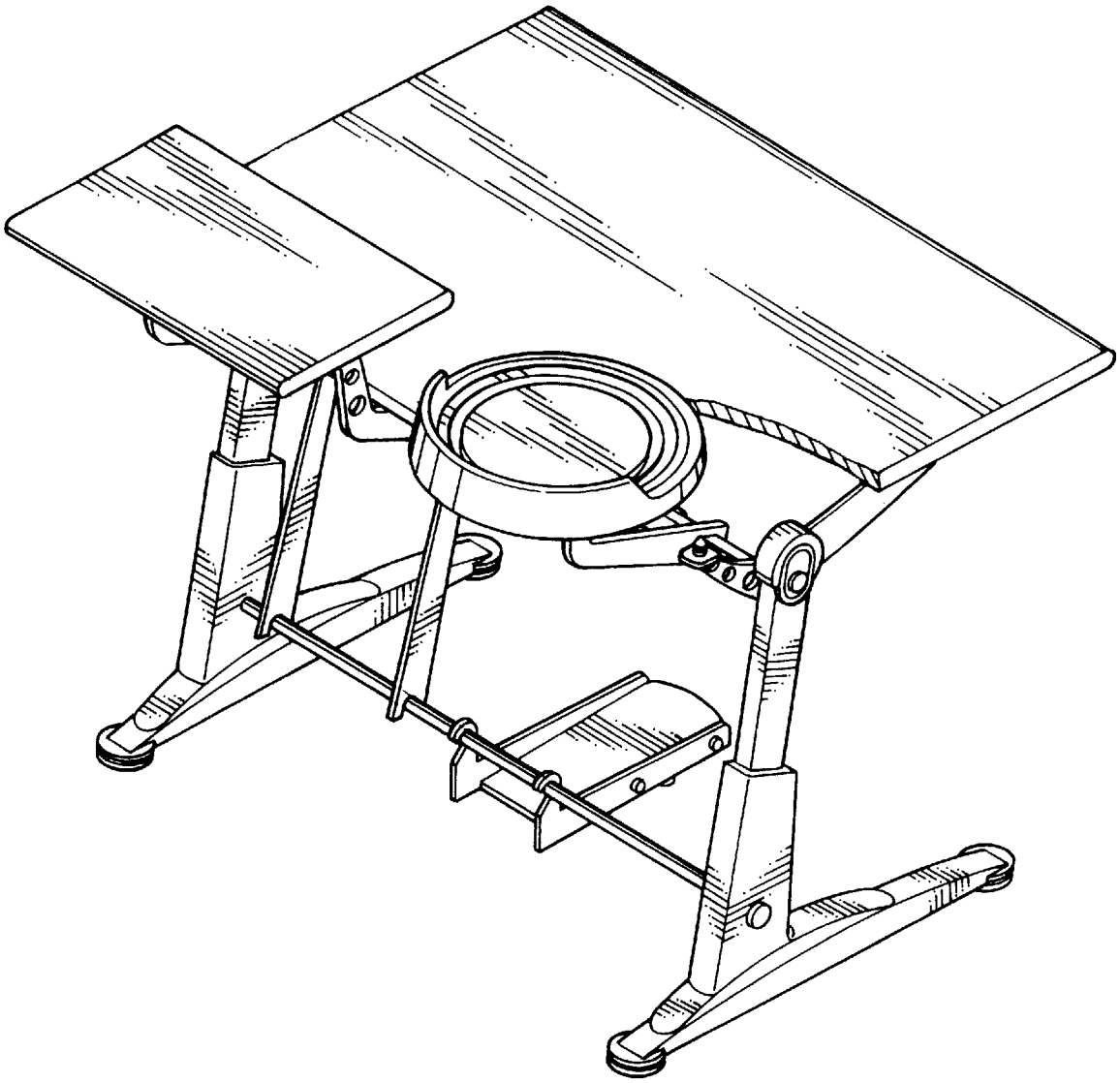
FIG. 5 shows a perspective view of a computer desk of the present invention.

As shown in FIGS. 1–4, a computer desk embodied in the present invention is composed of a desk top 1, a reference slide 2, an article tray 3, a stationery rack 4, a drawer 5, a plurality of legs 6, a plurality of leg supporting base 7, a cross rod 9, and a connection rod 10.

The desk top 1, the reference slide 2, and the article tray 3 are supported and connected by three support frames A, B, and C, which are fastened with the cross rod 9. The support frames are grouped into three sets, A (A), B (B), and C (C). Each set is provided with a fastening portion 13 and a locating piece 14. The A (A) set is of a V-shaped construction for supporting the desk top 1 such that the fastening portion 13 is fastened with the cross rod 9, and that the locating piece 14 is fastened with the cross rod 9 by a locating screw. The two support arms 15 are provided with a fastening piece 16, which is located under the desk top 1. The B (B) set is of an L-shaped construction and is provided with a fastening portion 13 and a locating piece 14. The two support arms 15 are provided with a fastening piece 16, which is located under the reference side 2. The C (C) set is of an L-shaped construction forming an angle greater than 90 degrees. The C (C) set is provided with two support arms 15 which are connected with each other at the top ends thereof and are provided with a fastening portion 13 and a locating piece 14. The top ends of the two support arms 15 are fastened with a U-shaped connection seat 19 by a rivet. The U-shaped connection seat 19 is provided with an inverted U-shaped fastening seat 20. The C (C) set is intended to support the article tray 3, which is provided in the periphery thereof with a stop edge 31 and a fitting piece 32 of a hollow construction and engageable with the fastening seat 20. The fitting piece 32 and the fastening seat 20 are fastened securely together by a bolt which is received in a bolt hole 201 of the fastening seat 20. The article tray 4 is held by the connection rod 10 such that the article tray 4 is held stably on a support seat 41. The drawer 5 is provided with a plate body 51, a support body 52, and a groove 53 dimensioned to fit over the cross rod 9. The support body 52 is provided with an arcuate indentation 54, which is engaged with the connection rod 10.

Figure 6:
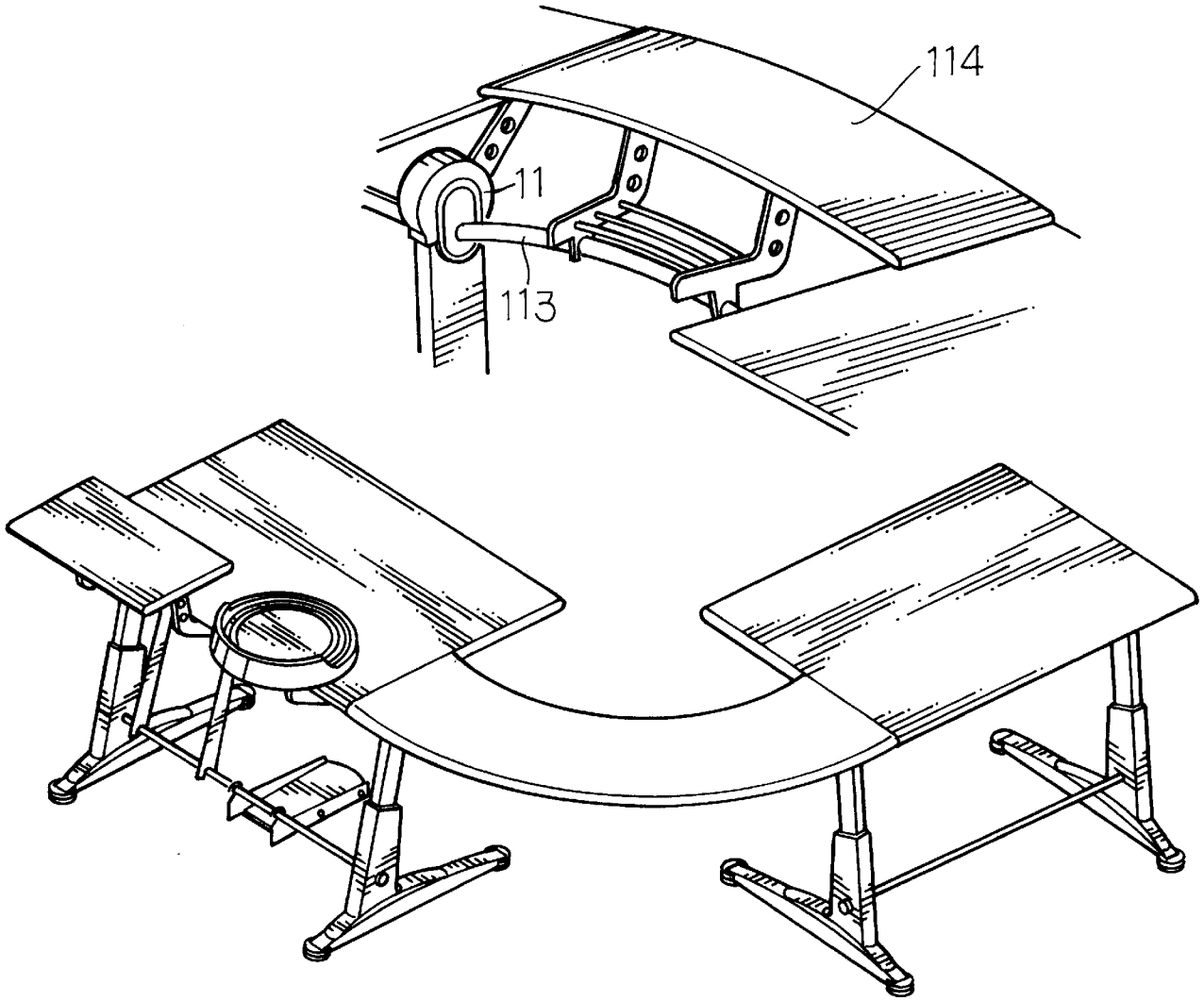
FIG. 6 shows a schematic view of the application of the computer desks of the present invention.

The two legs 6 are supported by two leg supporting bases 7 in conjunction with the connection rod 10 and the cross rod 9. The leg supporting bases 7 are provided at the top end thereof with a slot 71 into which one end of the leg 6 is inserted. The two leg supporting bases 7 are connected by the connection rod 10. The legs 6 are provided at the top end thereof with a fitting seat 11 which is provided with a round hole 112 dimensioned to receive a curved tube 113 for connecting two computer desks of the present invention side by side. The curved tube 113 is provided with a support board 114 for providing an added work space, as shown in FIG. 6.

The embodiments of the present invention described above are to be deemed in all respects as being merely illustrative and not restrictive. Accordingly, the present invention may be embodied in other specific forms without deviating from the spirit thereof. The present invention is thereof to be limited only by the scopes of the following appended claims.

What is claimed is:

1. A computer desk comprising a desk top, a reference slide, an article tray, a stationery rack, a drawer, two legs, two leg-supporting base, a cross rod, and a connection rod, said desk top, said reference slide, and said article tray being supported and connected by a first support frame, a second support frame and a third support frame, said support frames being fastened with said cross rod and grouped into three sets, with each of three sets being provided with a fastening portion and a locating piece, a first set being of a V-shaped construction for supporting said desk top such that said fastening portion is fastened with said cross rod, and that said locating piece is fastened with said cross rod by a locating screw, two support arms provided with a fastening piece located under said desk top, a second set being of an L-shaped construction and provided with a fastening portion and a locating piece, two support arms provided with a fastening piece located under said reference slide, a third set being of an L-shaped construction forming an angle greater than 90 degrees, said third set provided with two support arms which are connected with each other at top ends thereof and are provided with a fastening portion and a locating piece, said top ends of said two support arms being fastened with a connection seat which is provided with a fastening seat engaged with a fitting piece of a stop edge of said article tray, said drawer provided with a groove dimensioned to fit over said cross rod, and an indentation engaged with said connection rod, said two legs being supported by said two leg-supporting bases in conjunction with said connection rod and said cross rod.

2. The computer desk as defined in claim 1, wherein said two leg-supporting bases are provided at a top end thereof with a slot into which one end of said leg is inserted.

3. The computer desk as defined in claim 1, wherein said legs are provided at a top end thereof with a fitting seat which is in turn provided with a hole for receiving a curved tube for connecting two computer desks.

4. The computer desk as defined in claim 3, wherein said curved tube is provided with a support board located between the two computer desks for providing an added work space.

* * * * *